US006105224A

United States Patent [19]

O'Mara, Jr. et al.

[11] Patent Number: 6,105,224

[45] Date of Patent: Aug. 22, 2000

[54] BULK YARNS HAVING IMPROVED ELASTICITY AND RECOVERY, AND PROCESSES FOR MAKING SAME

[75] Inventors: J. Joseph O'Mara, Jr., Haverford, Pa.; Anthony Nesbitt Dotson, Hickory, N.C.

[73] Assignee: O'Mara Incorporated, Wayne, Pa.

[21] Appl. No.: 09/162,194

[22] Filed: Sep. 28, 1998

[51] Int. Cl.[7] ..... D02G 1/16; D02G 1/00

[52] U.S. Cl. ..... 28/271; 28/247

[58] Field of Search ..... 57/908, 6, 227, 57/351; 28/247, 271

[56] References Cited

U.S. PATENT DOCUMENTS

| | | | |
|---|---|---|---|
| 3,434,278 | 3/1969 | Martin et al. . | |
| 3,523,416 | 8/1970 | Wolf . | |
| 3,534,540 | 10/1970 | Collingwood et al. . | |
| 3,593,513 | 7/1971 | Reese . | |
| 3,681,910 | 8/1972 | Reese . | |
| 3,940,917 | 3/1976 | Strachan | 57/152 |
| 3,948,033 | 4/1976 | Henstock et al. | 57/140 |
| 3,959,962 | 6/1976 | Wilding . | |
| 3,991,548 | 11/1976 | Toronyi et al. | 57/205 |
| 4,180,968 | 1/1980 | White . | |
| 4,295,329 | 10/1981 | Windley . | |
| 4,452,160 | 6/1984 | Tajiri et al. . | |
| 4,755,336 | 7/1988 | Deeg et al. | 264/103 |
| 4,877,572 | 10/1989 | Clarke et al. . | |
| 4,894,894 | 1/1990 | Coons, III et al. . | |
| 5,008,992 | 4/1991 | Gehrmann et al. . | |
| 5,014,404 | 5/1991 | Smith | 28/271 |
| 5,213,733 | 5/1993 | Hwu et al. . | |
| 5,359,759 | 11/1994 | Jacob et al. | 28/271 |
| 5,389,327 | 2/1995 | Longhi . | |
| 5,391,703 | 2/1995 | Lin . | |
| 5,804,115 | 9/1998 | Burton et al. | 264/103 |
| 5,811,040 | 9/1998 | Mallonee | 264/78 |

*Primary Examiner*—John J. Calvert
*Assistant Examiner*—Robert H. Muromoto, Jr.
*Attorney, Agent, or Firm*—Alston & Bird LLP

[57] ABSTRACT

Bulk yarns having improved elasticity and recovery and methods for their manufacture are described. A first embodiment of the invention involves providing a solution-dyed multifilament yarn of polybutylene terephthalate (PBT) and a multifilament yarn of a second thermoplastic polymer to an air jet texturizer such that the PBT component forms a core and the other yarn forms a plurality of loops and coils extending outwardly from the core. In addition to a high degree of elasticity and recovery, the composite yarn also has a low amount of shrinkage, which enables the yarns to be used in the production of woven fabrics without significant losses in fabric yield. Another embodiment of the invention involves false twisting a multifilament PBT yarn and a second multifilament yarn as individual threadlines to impart crimp thereto, then entangling the two components together using an air interlacing jet, to produce a bulk yarn having high elasticity and recovery. Because the two components have different optimal draw ratios, the process involves the simultaneous drawing of the components at different draw ratios such as by running different diameter first delivery rolls for the respective components on the first delivery shaft of the machine. Alternatively, a supplemental individually-controllable first delivery shaft can be provided on the machine for feeding one of the components at a different speed from the other, to thereby draw the components at different ratios relative to each other. The thus-crimped yarns are then entangled together using an air entanglement jet, to produce a bulk yarn having high elasticity and recovery.

10 Claims, 3 Drawing Sheets

BULK YARNS HAVING IMPROVED ELASTICITY AND RECOVERY, AND PROCESSES FOR MAKING SAME

BACKGROUND OF THE INVENTION

1. Field of the Invention

The invention generally relates to textured multi-component yarns having increased elasticity and recovery, and processes for their production. More specifically, the invention relates to multi-component yarns having a polybutylene terephthalate component and a component of another thermoplastic material, and having good physical and aesthetic properties along with improved elasticity and recovery, and processes for their production.

2. Description of the Prior Art

Fabrics woven from synthetic yarns such as those made from textured polyethylene terephthalate (PET) are commonly used in many applications, due in part to their strength and durability. The types of yarns used are selected to achieve the desired properties for the intended end use. For example, air jet textured yarns are often utilized because of the ease with which they can be produced. One disadvantage of fabrics made from air jet textured PET yarns is that they generally have limited elasticity/recovery capability. This becomes particularly apparent when the fabric woven from such yarns is used to cover an irregularly-shaped article. For example, when fabrics woven from conventional bulk PET yarns are to be used to cover items such as automotive seating, it can be difficult to get a close fit of the fabric without extensive labor input to custom-fit the fabric to the seat. As a result, such fabrics can tend to pucker and gap, thereby causing a reduced quality appearance. Furthermore, since such seating is generally cushioned, it often results that the fabric is worn undesirably as a result of its inability to stretch and recover when the cushioned seating is compressed, as when someone sits on it.

Attempts have been made to increase the elasticity of air jet textured PET yarns used in woven fabrics; however, such attempts typically have involved increasing the amount of shrinkage in the yarns, since an increase in elasticity and recovery generally accompanies an increase in shrinkage. However, increasing the shrinkage in the yarn end product can be particularly difficult when it is desired that the yarns are to be colored. In processes where the PET yarns are package dyed, the heating stage of the dye process tends to virtually eliminate the ability of the yarns to shrink. As a result, the package-dyed air jet textured PET yarns generally have little to no elasticity or recovery capability.

The other option generally available for obtaining dyed PET yarns having some elasticity is by solution dyeing the yarns (i.e., introducing polymer pigments or insoluble dyes into the polymer melt or spinning solution prior to extrusion), and false twist texturing them, since false twisting generally produces yarns having high levels of shrinkage. Because the color is therefore inherent in the yarn prior to texturizing, the elastic properties of the yarn can be retained. However, because the yarns retain a relatively high level of shrinkage, when fabrics woven from the solution-dyed false-twist textured PET yarns are subjected to heat during fabric finishing processes, they have a tendency to shrink, leading to significant yield losses and quality problems in the end product.

Another attempt for increasing the stretchability of PET fibers is described in U.S. Pat. No. 4,755,336 to Deeg, et al. This patent describes a process for melt spinning a blend of about 5 to 25% by weight of polyethylene terephthalate (PET) with polybutylene terephthalate (PBT), to produce a yarn having increased stretchability. As described in the patent, the fibers are drawn at an elevated temperature following extrusion to induce a specific form of crystal. The yarns are then subjected to a heat relaxation treatment which changes the crystal form of the polybutylene terephthalate to add shrinkage, thereby causing the fibers to have an increased degree of stretchability. Because the polybutylene terephthalate and polyethylene terephthalate are mixed while in their molten form, the resulting yarns would have properties which are essentially a compromise between the properties of the two material inputs, and thus which would differ from the physical and aesthetic properties of the all-PET yarns. In addition, because the elasticity is increased by increasing yarn shrinkage, the problem of yield loss would still exist when the yarns are converted to a finished product. Furthermore, the large majority of the material input is PBT, and because PBT is generally more expensive than PET, the yarns discussed in the Deeg, et al. patent would tend to be significantly more expensive than the all-PET yarns.

Thus, a need exists for yarns which can be used in the production of woven fabrics which have a good degree of elasticity and recovery, along with good physical and aesthetic properties. In addition, a need exists for yarns which can be used in the production of woven fabrics having increased elasticity and recovery, at set levels of shrinkage.

SUMMARY OF THE INVENTION

The instant invention overcomes the deficiencies of the prior art by providing bulk yarns having high elastic recovery and superior elasticity, while also providing superior color, hand and appearance characteristics.

In addition, certain embodiments of the invention provide increased elasticity and recovery along with low shrinkage. This is surprising because the characteristics of high elasticity and recovery and low shrinkage are typically at odds with each other. As a result, the yarns of these embodiments of the instant invention enable the production of superior fabrics having improved elasticity and recovery, which would be expected to enable the fabrics to more readily conform to irregularly-shaped articles such as automotive seating.

The yarns of the first embodiment of the invention are achieved by providing solution-dyed polybutylene terephthalate (PBT) filaments and filaments of a different thermoplastic polymer (e.g., polyethylene terephthalate (PET) or nylon) to an air jet texturizer to form a core-bulked yarn, where the PBT filaments form the core and the filaments of the other polymer form a coiled or looped effect yarn about the PBT core.

The PBT material is desirably combined with organic and/or inorganic pigments while it is in a flowable form (e.g., molten), to provide a colored PBT material. This material is then spun into a plurality of polymer material streams using a conventional melt spinning operation, and the streams are then quenched to at least partially solidify the streams into a plurality of solution-dyed PBT filaments. Because the dyeing occurs during the spinning process, the disadvantages associated with package dyeing (e.g., problems of dye bath disposal without adverse environmental impact, etc.) can be avoided.

The individual filaments are gathered into a bundle, and wound under tension to form a PBT yarn structure. Preferably, the filaments are also intermingled during the gathering process such as through the use of an interlacing jet, so that the filaments form a cohesive bundle.

The thus-produced solution-dyed multifilament PBT yarn is then fed to an air jet texturizer along with another multifilament yarn of a different thermoplastic material, which is selected to provide the composite yarn with specific physical and aesthetic characteristics. For example, the other multifilament yarn can be a polyester or nylon multifilament yarn, since these fibers provide good strength, hand and appearance, yet are relatively inexpensive. The second yarn component is also desirably solution-dyed to the same color as the PBT component, although the component could be provided as different color(s) depending on the choice of the manufacturer.

The PBT component and the other yarn component are desirably each individually fed through separate drawing arrangements, in order that each of the respective yarn components can be drawn to its preferred optimal draw ratio. For example, where the second component is formed from PET, the PBT component may desirably be drawn at a lower draw ratio than the PET component. The respective drawing arrangements desirably utilize a plurality of heated rollers, to facilitate in the drawing and heat setting of the yarns.

The two yarn components are then fed to an air jet texturizer to form a core-bulked yarn structure, with the PBT component representing the core of the composite yarn. In other words, the feeding arrangement is such that the PBT yarn establishes itself as the core component while the second yarn component forms a plurality of coils and loops extending outwardly from the PBT core. For example, the PBT yarn can be fed to the air jet texturizer at a slower rate than the other component, and/or the PBT component can be guided through a liquid bath prior to entry into the air jet.

Because the aesthetic characteristics of the thus-produced yarns are predominantly dictated by the effect yarn, the yarns therefore appear substantially the same as those made entirely from the effect yarn material. However, the multicomponent yarns have been found to have greater elasticity and recovery than is achieved by those formed entirely from the effect yarn material, at the same levels of shrinkage. Stated differently, yarns at the same levels of elasticity and recovery as prior art yarns would have lower levels of shrinkage, and thus smaller yield losses. As a result, the multicomponent yarns can be used to produce fabrics having a good degree of elasticity and recovery, and a low level of shrinkage, which means that the fabrics do not experience the yield losses commonly experienced with the prior art fabrics.

A second embodiment of the invention involves the production of multicomponent yarns by false-twist texturing as individual threadlines each of a PBT yarn component and a multifilament yarn component of another thermoplastic material (e.g., PET or nylon), then combining the two yarn components using an air entanglement jet. Because the natural draw ratios of the PBT component and the other yarn component are different, the process also involves drawing each of the yarn components during the texturing process using different draw ratios for each. Although the thus-produced yarns retain some shrinkage (particularly due to their false-twisted nature), they have an enhanced level of elasticity and recovery, and good strength and aesthetic characteristics. As a result, they are particularly useful in the production of woven fabrics having a high degree of elasticity and recovery along with good hand and appearance.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
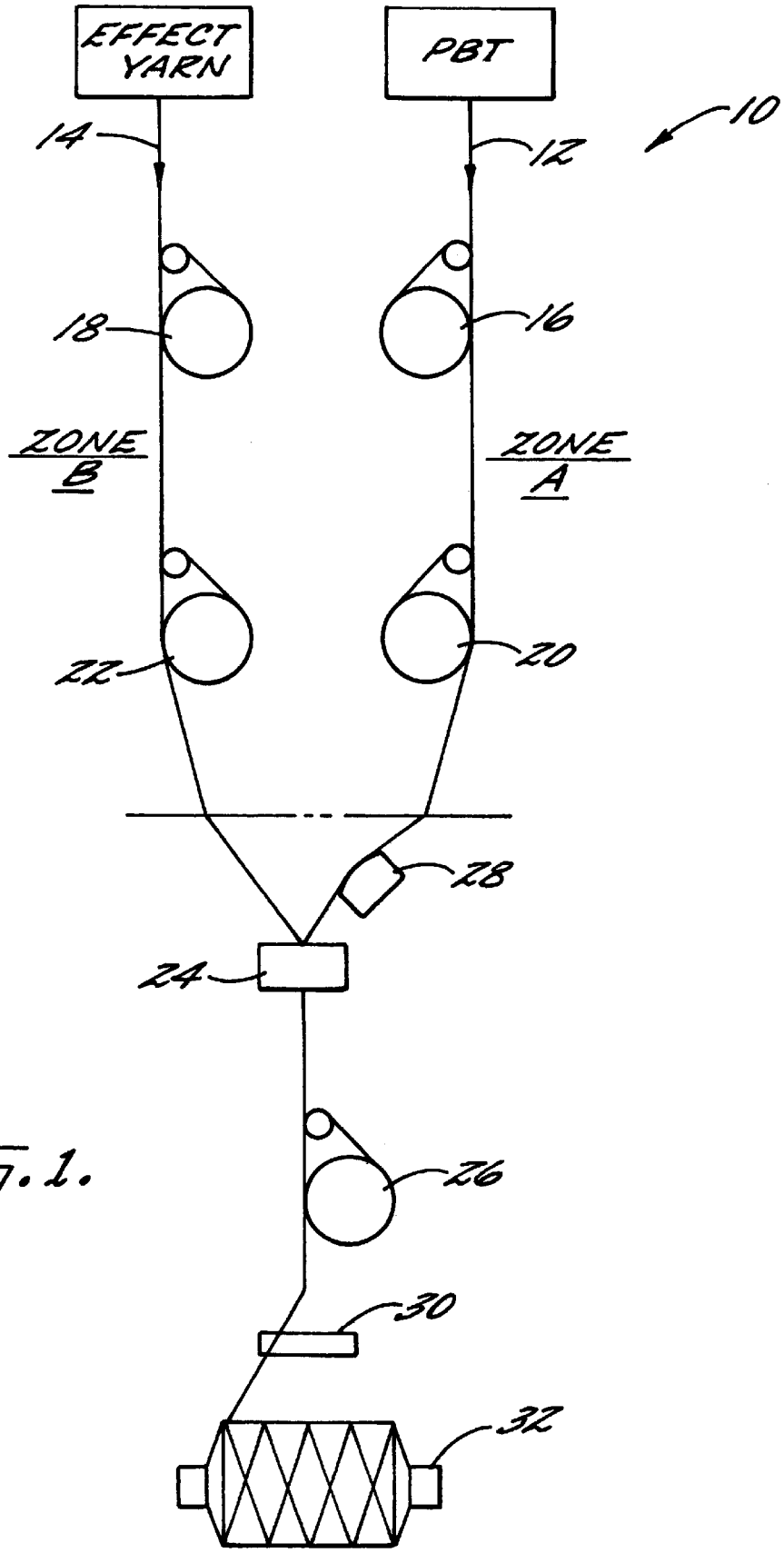
FIG. 1 illustrates a first process according to the instant invention.
Figure 2:
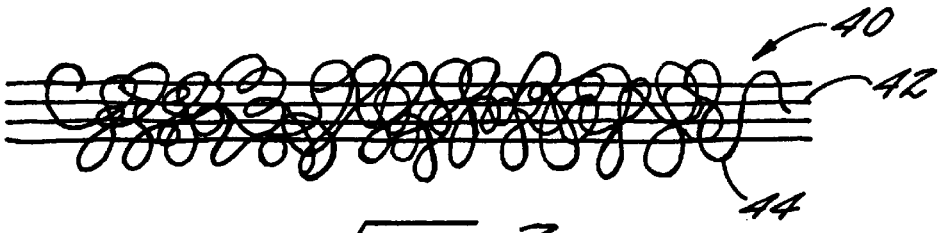
FIG. 2 is an enlarged view of a yarn made according to a first embodiment of the instant invention.

With reference to the drawings, FIG. 1 illustrates a process for manufacturing multicomponent yarns according to a first embodiment of the invention, while FIG. 2 illustrates an enlarged view of a yarn made according to the method of FIG. 1.

A process for making a yarn according to the instant invention is shown generally at 10. As illustrated, a yarn 12 made from polybutylene terephthalate (PBT) is supplied, as is a second yarn 14 which is to form the effect yarn of the composite. The second yarn 14 is desirably selected to provide the composite with particular aesthetic and functional qualities, as will be discussed further herein.

The PBT yarn 12 is preferably solution-dyed in a conventional manner. For example, the PBT chips can be supplied to a storage hopper, where they are initially dried, while a predetermined quantity of pigments are provided to a second hopper, where they are also dried. The pigments can be of any type effective in dyeing PBT without adversely affecting its physical properties, and can be in the form of organic or inorganic pigments, or a combination thereof. The pigments are desirably provided in chip form, although other forms may be appropriate depending on the color which is to be attained.

The PBT and pigment are then mixed together in a conventional manner in the appropriate ratios which will achieve the filament color desired. For example, the PBT chips and pigment can be fed to a gravimetric control blender which is capable of mixing the polymer/pigment combination very precisely. The polymer/pigment combination is then desirably fed into the throat of an extruder, such as a single or twin screw extruder. The extruder is adapted to feed the chip-form polymer/pigment mixture, transition the chip mixture from solid phase to liquid phase (e.g., by mechanical and/or electrical means, such as by heating the mixture to molten form), then metering the mixture from the extruder into a heated transfer line. In-line mixers and/or inverters such as the type commonly used in PET spinning operations are also desirably provided to further mix the combination of the PBT and the pigment.

The mixture is then spun in a conventional manner into a plurality of polymer streams; in a preferred form of the invention, the mixture is metered through a precision metering pump and through a spin-pack which provides both filtration and shear prior to extruding the material into filaments, in a manner which will be understood by those having skill in the art. The polymer streams are then desirably drawn and quenched to form a plurality of polymer filaments, and brought together as one threadline. At this point, it may also be desirable to add a finish to the yarn prior to winding it on a bobbin.

In a preferred form of the invention, the filaments are intermingled prior to being wound up, as by contacting them with a conventional type of air interlacing jet such as those commonly used in the production of 100% PET yarns. Because the filaments are generally only partially oriented following spinning, the yarn is desirably wound onto the bobbin at speeds from about 2500 m/min to about 3500 m/min during the take-up process in order to further align the molecular chains in the filaments by providing a degree of drawing thereto.

The second yarn component 14 which is to form the effect yarn component in the composite yarn of the invention is prepared in a conventional manner used to spin multifilament thermoplastic yarns. The second yarn component is selected to provide specific aesthetic and functional characteristics to the composite yarn, and can be PET, nylon, or other types of thermoplastic multifilament yarns conventionally known in the art. The second yarn component 14 has also desirably been solution-dyed in a conventional manner such as that described above with respect to the PBT yarn component. In a preferred form of the invention, the second yarn component has been dyed to substantially the same color as the PBT yarn component 12, although other colors could be used within the scope of the instant invention.

As illustrated, the PBT yarn component 12 is fed along a series of first and second godets 16, 20, respectively, between which exists a draw zone A. For example, the PBT component is desirably drawn at a ratio of about 1.4. Similarly, heated godets 18 and 22 define a draw zone B for the second yarn component 14 of the composite. For example, where the second yarn component is PET, the draw ratio is desirably about 1.7. The draw ratio for each of the yarn inputs can be selected to achieve optimal results from the composite yarn without resort to undue experimentation, as will be readily appreciated by thus having ordinary skill in the art.

In a preferred form of the invention, the godets 16, 18, 20, 22 are controlled at temperatures designed to facilitate the drawing and heat setting of the two yarn components. For example, godets 16 and 18 are desirably set at a temperature designed to raise the respective yarns above their respective glass transition temperatures, while godets 20 and 22 are desirably at a higher temperature, for heat setting the molecular structure of the polymer materials while the yarns are in a stressed and oriented state. For example, the first godets 16, 18 are desirably controlled at about 130 degrees Celsius while the second godets 20, 22 are desirably maintained at about 180 degrees Celsius.

The two components 12, 14 are desirably fed to the air jet texturizer 24 such that the PBT component establishes itself as the core of the composite and the other yarn establishes itself as the effect yarn, forming a plurality of loops and spirals extending outwardly from the PBT core. For example, the feeding ratio between godet 20 and downstream godet 26 (which establishes the feed rate of the PBT component 12) can be set at a slower rate than that between godet 22 and 26 (that which establishes the feed rate of the other yarn component 14). Also in a preferred form of this embodiment of the invention, the PBT yarn component 12 is guided through a liquid bath 28 while the effect yarn 14 is not, so that the effect component has a greater tendency to develop loops, coils, etc. while passing through the air jet 24. The air jet can be of a conventional variety, such as that sold by Heberlein as model T341K, and is set according to conventional levels used to texturize 100% PET corebulked yarns. Throughput speeds of about 400 m/min have been found to perform well in the instant invention.

The downstream godet 26 preferably has low to no heat, in order that the PBT component filaments maintain a highly stressed structure, as this is advantageous for retaining good elasticity and recovery properties in the final product. The composite yarn is then desirably oiled as shown at oiler 30, using conventional lubricants, then taken up in a conventional manner such as on a bobbin, as shown at 32.

The thus-formed yarn 40, as illustrated in FIG. 2, has a core-bulk yarn construction, with the PBT filaments 42 (corresponding to input yarn 12 in FIG. 1) forming the core of the composite and the other component filaments 44 (corresponding to input yarn 14 in FIG. 1) extending outwardly from the core in the form of coils and/or loops. The yarn therefore has substantially the appearance and feel of a yarn made entirely from the effect yarn, while having good elasticity and recovery capabilities.

In addition, the yarn has a reduced shrinkage over similar yarns formed from 100% of the effect component having the same elasticity and recovery, or stated differently, the yarn of the invention has higher elasticity and recovery at similar shrinkage levels with the prior art yarns. Furthermore, because the pigment was dispersed throughout the solution-dyed polymer materials of the respective filaments, the yarns have consistent even color throughout.

Thus, as can readily be seen, the recovery levels of the yarns produced according to the instant invention were increased as compared with those of all-PET at similar shrinkage levels.

The resulting yarns produced according to the instant invention desirably have an overall size of between about 150 denier and 1200 denier, with the individual filaments of each of the components having a size between about 1 and 5 dpf. In addition, the PBT component preferably accounts for about one-third of the overall makeup of the composite yarn, while the second yarn component accounts for about two-thirds of the overall composition of the composite yarn. Preferably about 50–600 individual filaments of PBT are included in the overall composite yarn. Similarly, the second yarn component 14 (i.e., the effect component in the yarn of this embodiment of the invention) includes a plurality of individual filaments each about 1 to 5 denier in size, and preferably accounts for about two-thirds of the overall makeup of the composite yarn. However, it will be appreciated by those of ordinary skill in the art that different proportions of the two material inputs are well as different size of the filaments of the respective components may be utilized within the scope of the instant invention. Also, while the second yarn component has been described as being of a specific material, it is noted that the second yarn component could include filaments of more than one variety (i.e., multiple sizes or cross-sections, or plural materials, etc.) within the scope of the instant invention.

The yarns described above have been found to be useful in the production of fabrics and in particular, woven fabrics which have a good degree of elasticity and recovery, yet which do not realize significant yield losses upon fabric finishing. Because of the improved elasticity and recovery, the fabrics are better able to conform to the shape of an object to be covered and to adapt to compression and recovery of the article, as in the case of cushioned seating.

Figure 3:
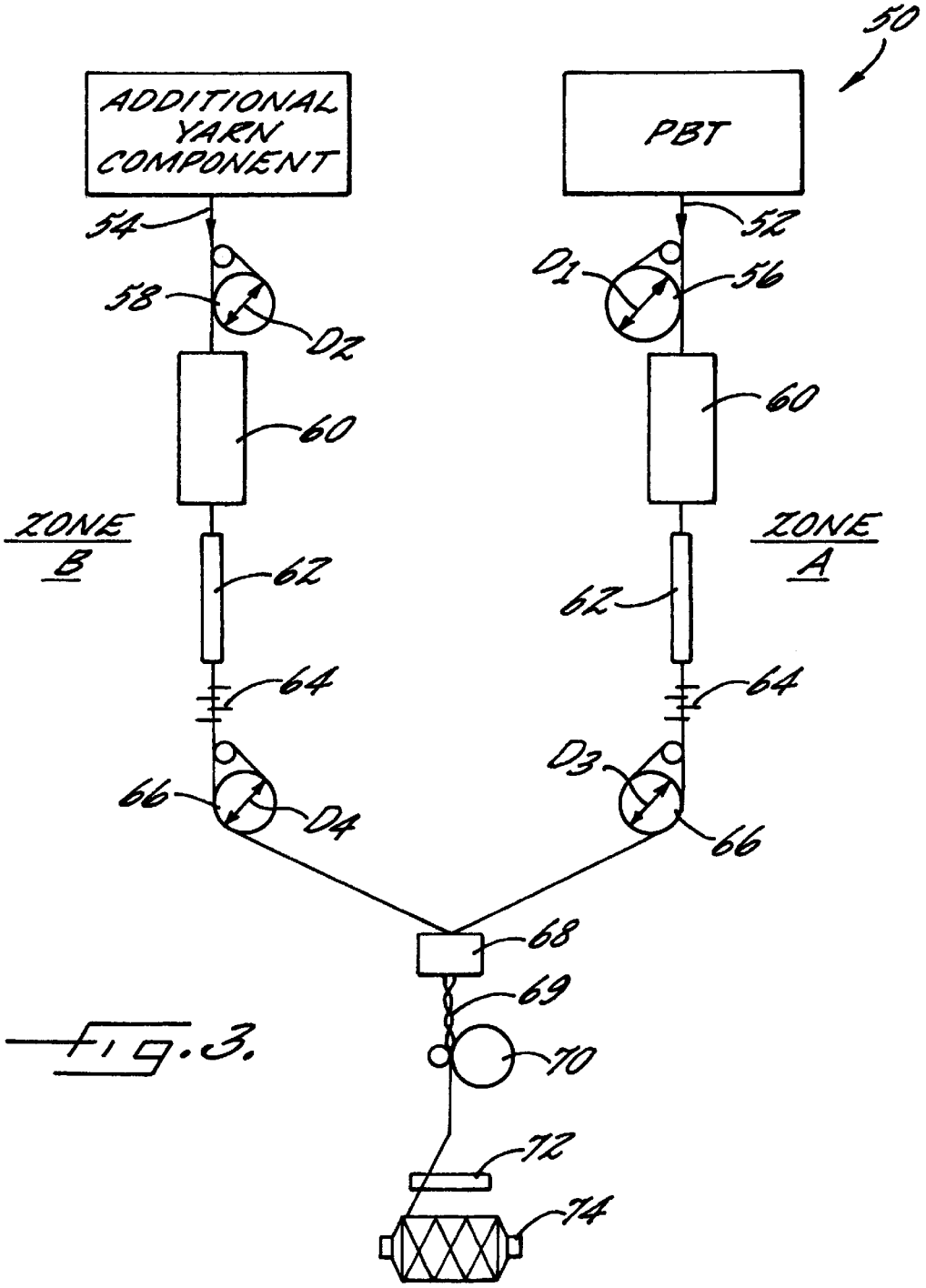
FIG. 3 illustrates another process according to the instant invention.

An alternative process according to the instant invention is illustrated in FIG. 3, shown generally at 50. In this process, a PBT yarn component 52 is false-twist textured using a conventional-type false-twist texturizer, while a second yarn component 54 is also textured as an individual threadline using a false twist texturizer. The two textured yarn components are then combined using an air entanglement jet 68, to produce bulk composite yarns. Because the natural draw ratios of the PBT component and the second component are different, they therefore are drawn at different levels. This is performed simultaneously according to the instant invention.

Each of the two yarn components has desirably been solution-dyed in a conventional manner, such as the one described above with respect to the first embodiment of the invention, and preferably such that the two components are of the same color. Alternatively, however, the two yarn components could be different colors, if so desired by the manufacturer.

In one form of the process, the first delivery shaft of the texturing machine is provided with first and second rollers 56, 58, respectively, which are rotated by a single delivery shaft so that they rotate at the same speed. Unlike conventional arrangements, however, the two rollers 56, 58 have different diameters from each other, so that the respective yarns processed therethrough are drawn at different ratios from each other. This feature of the process is illustrated in FIG. 3. As shown, the PBT yarn component 52 is processed using a first delivery roller 56 having a diameter of D1, while the second yarn component 54 is processed using a first delivery roller 58 having a diameter of D2 where D2 is <D1. For example, where the second yarn component is PET, the PBT can be drawn at a 1.4 ratio in the texturing zone A while the PET element is drawn at a ratio of about 1.7 in zone B, by using roll diameters of D1=(1.7/1.4)D2 while the shaft speeds of the first and second delivery rollers are running a 1.7 draw ratio with respect to the diameter of the first delivery roll 58 processing the second yarn component.

Alternatively, a separate first delivery shaft (not shown) which is controllable at a different speed from that of the existing first delivery shaft can be provided, such as by retrofitting conventional equipment, so that the respective yarn components can be fed at different rates to thereby be processed at different draw ratios simultaneously on the same machine.

Each of the two yarn components is fed through a heater 60 and subsequent cooling element 62, then through a conventional-type false twist device 64, so that the individual threadlines are imparted with crimp, which will generally be substantially coil-shaped. The respective first and second yarn components 52, 54 are then fed together to an air interlacing jet 68 by way of rolls 66, where they are intermingled to form a bulky composite yarn 69. The composite yarn 69 is then desirably removed from the air interlacing jet 68 by a roller 70 and oiled in a conventional manner as at 72, using finishing products commonly available on the market. The composite yarn 69 is then desirably taken-up, such as on a bobbin 74, and transported or stored until further use.

Figure 4:
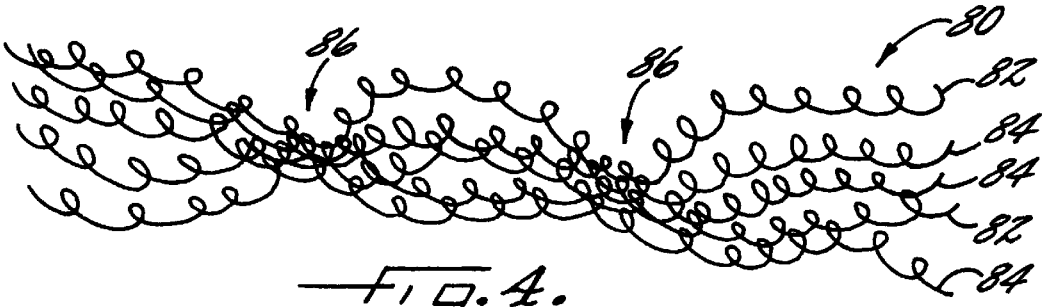
FIG. 4 illustrates an enlarged view of a yarn made according to the process of the invention illustrated in FIG. 3.

A yarn produced according to this method is illustrated generally at 80 in FIG. 4. As illustrated, the filaments of the PBT yarn 82 and the other yarn 84 have a coil-shaped crimped configuration as a result of the false-twisting operation, and nodes of entangled filaments 86 are formed along the length of the yarn structure. As will readily be recognized by those of ordinary skill in the art, actual yarns will include more than the five filaments shown, the figure being intended for illustrational purposes only.

Figure 5:
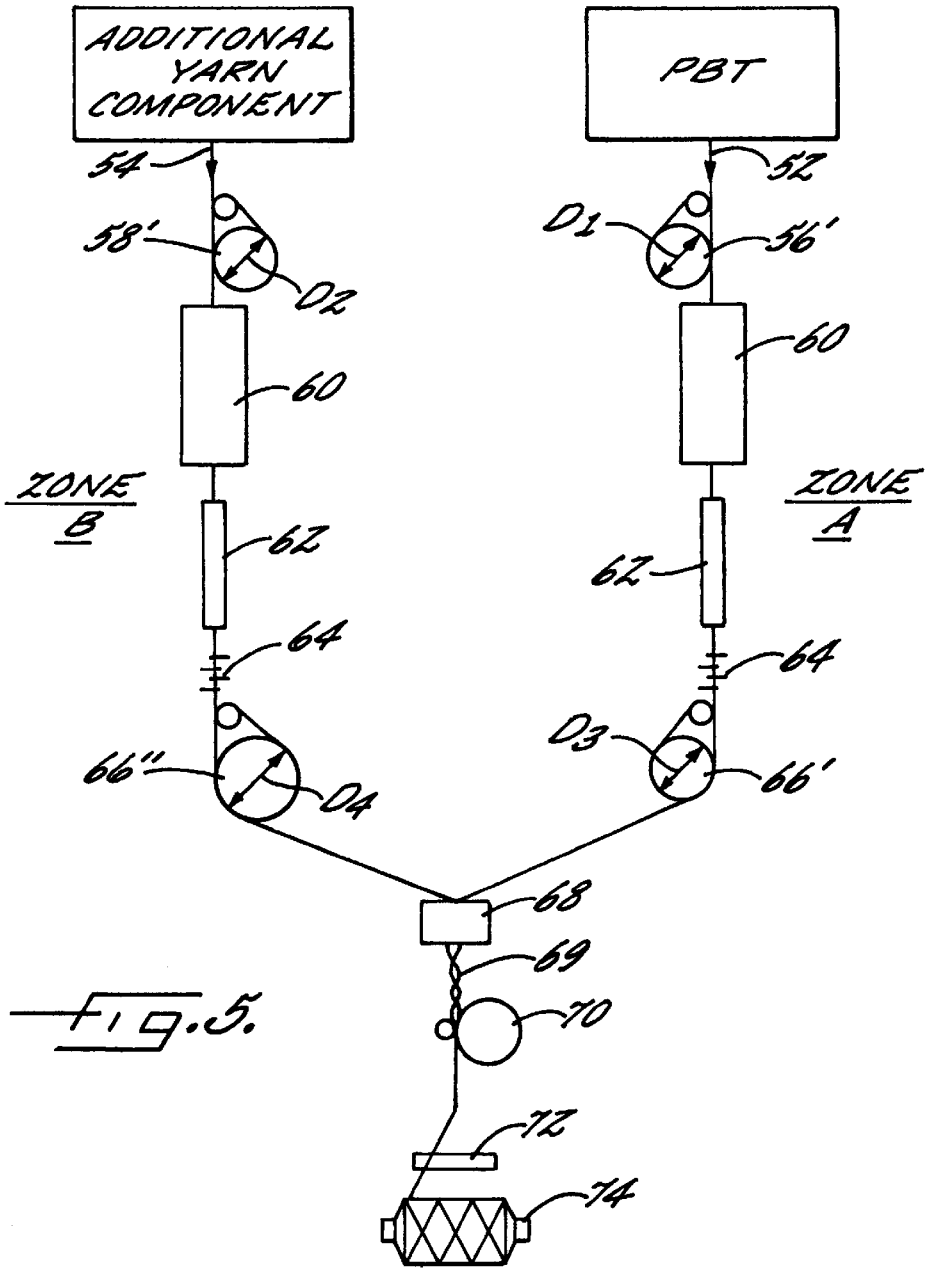
FIG. 5 illustrates a process like that shown in FIG. 3, but with the roll size modification occurring on the second roll rather than the first.

An alternative arrangement for performing the process illustrated in FIG. 3 is shown in FIG. 5, with like numbers representing like elements in each of the two figures. In this arrangement, the first and second rollers 56', 58' are the same or similarly sized, and the third and fourth rollers (on the second shaft) are differently sized, so that the components are processed at different draw ratios. In this case, the diameter D3 of roller 66' is less than the diameter D4 of roller 66", so that the PBT component is processed at a lower draw ratio than the other component.

The thus-produced yarns have a very high degree of elasticity and recovery, although they retain a greater degree of shrinkage than the yarns described in the first embodiment of the invention. In addition, the yarns have a high level of tenacity, as well as good bulk and hand. Although it is specifically described that the PBT yarn component can be mixed with PET, it is noted that other fibers such as nylon or combinations of fibers can be used to form the second yarn component, within the scope of the instant invention.

EXAMPLES

Example 1

A fabric width of 64 inches was woven from like-sized false twist textured yarns of each of 1) a conventional high shrink all-PET yarn, 2) a competitor's product which is a melt-spun blend of PET and PBT (such as that described in the Deeg et al. patent described above), and 3) a false-twist textured, air jet entangled blend of PET and PBT according to the second embodiment of the instant invention. The fabric made from the all-PET yarn drew into 54 inches, the fabric from the melt-spun blend of PET and PBT drew to 51 inches, and the fabric from the falst-twist textured blend of PET and PBT made according to the instant invention drew to 49 inches. All of the yarns were then pulled back to 54 inches after backcoating, thereby illustrating that the false-twist textured product of the instant invention has 67% more recovery/elasticity at similar shrink levels than that of the the competitor's product.

Example 2

Similarly, the recovery levels of various yarns at similar shrinkage levels were tested using ASTM D3160-89 as follows:

A false twist textured 3/150 all PET yarn was tested, with 11% recovery.

A false twist textured 3/150 yarn made according to the invention, including 1/3 PBT and 2/3 PET was tested, and exhibited 33% recovery.

A 1000 denier yarn having 1/3 PBT and 2/3 PET was produced according to the air jet textured embodiment of the instant invention, and yielded 15% recovery.

A 1000 denier yarn having 1/2 PBT and 1/2 PET was produced according to the air jet textured embodiment of the instant invention, and yielded 16% recovery.

A 1000 denier yarn of 100% PET was air jet textured in the manner of the process described according to the instant invention, and yielded 5% recovery.

The composite yarns desirably include at least about 30% PBT, and preferably as much as about 50% PBT, with the individual PBT filaments desirably having deniers of about 1 to about 5 dpf. Likewise, the filaments of the second component desirably have individual sizes of about 1 to about 5 dpf. In a preferred form of the invention, the composite yarns are about 150 denier to 1200 denier in size. Because of their high degrees of elasticity, recovery, and strength, and good feel and appearance, the yarns are useful, among other things, in the production of woven fabrics such as those used to cover automotive seating and the like. Because the fabrics have an improved ability to stretch and retract, they can be readily contoured to an irregularly-shaped article, thereby providing an enhanced, high quality appearance.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A process for making a bulk yarn having high elasticity and recovery capabilities comprising the steps of:

feeding to an air jet texturizer a first polybutylene terephthalate multifilament yarn and a second multifilament yarn of a thermoplastic polymer material other than polybutylene terephthalate and blowing said yarns with an air jet to entangle the filaments of the first and second yarns with each other to thereby form a bulk multi-component yarn.

2. The process according to claim 1, wherein said step of feeding is performed such that said first multifilament yarn of polybutylene terephthalate generally forms a core while the filaments of said second multifilament yarn form a plurality of loops extending outwardly from the core formed by the first yarn.

3. The process according to claim 2, wherein said feeding is performed such that said multifilament yarn of PBT is fed to the air jet texturizer at a slower rate than said second multifilament yarn.

4. The process according to claim 1, wherein the filaments forming said first multifilament yarn of polybutylene terephthalate are intermingled with each other to form a cohesive structure prior to said step of feeding the yarn to the air jet texturizer.

5. The process according to claim 1, wherein the filaments forming the polybutylene terephthalate multifilament yarn are partially drawn prior to said step of feeding the yarn to the air jet texturizer.

6. The process according to claim 1, wherein the first and second yarns are solution-dyed yarns.

7. The process according to claim 1, further comprising the step of individually false twist texturizing each of the first and second yarns to impart crimp to the filaments thereof prior to the step of feeding said yarns to the air jet texturizer.

8. The process according to claim 7, wherein said step of texturizing said first and second yarns includes drawing the yarns at different draw ratios relative to each other.

9. The process according to claim 8, wherein said step of drawing the first and second yarns at different draw ratios comprises feeding the first yarn to a false twist device using a first delivery roller rotating at a defined speed and feeding the second yarn to the false twist device using a second delivery roller rotating at the same defined speed as said first roller, wherein the diameter of the first roller is different from that of the second roller such that the first and second yarns are drawn at different draw ratios relative to each other.

10. A process according to claim 8, wherein said step of drawing the first and second yarns at different draw ratios comprises feeding each of the first and second yarns through a draw zone defined by an upstream delivery roller and a downstream godet which rotates at a greater speed than the upstream delivery roller, where the relative rotational speed of the delivery roller for the first yarn is different from the rotational speed of the delivery roller for the second yarn, to thereby define different relative draw ratios for the first and second yarns.

* * * * *

UNITED STATES PATENT AND TRADEMARK OFFICE
CERTIFICATE OF CORRECTION

PATENT NO. : 6,105,224

DATED : August 22, 2000

INVENTOR(S) : O'Mara, Jr. et al.

It is certified that error appears in the above-identified patent and that said Letters Patent is hereby corrected as shown below:

Column 9, lines 28-29, cancel "polybutylene terephthalate"; line 29, after "yarn" insert --of polybutylene terephthalate material--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*